US005586820A

United States Patent [19]

Klink

[11] Patent Number: 5,586,820

[45] Date of Patent: Dec. 24, 1996

[54] MULTIDIRECTIONAL TASK LAMP

[76] Inventor: Andrew K. Klink, 865 First Ave., New York, N.Y. 10017

[21] Appl. No.: 518,049

[22] Filed: Aug. 22, 1995

[51] Int. Cl.[6] ..... F21V 21/18

[52] U.S. Cl. ..... 362/402; 362/275; 362/401; 362/419

[58] Field of Search ..... 362/275, 287, 362/288, 401, 402, 410, 414, 419, 427; 248/125.1, 291.1, 292.13

[56] References Cited

U.S. PATENT DOCUMENTS 3,280,322 10/1966 Kirkeby ..... 362/402
4,974,139 11/1990 Chin-Song ..... 362/410
5,050,054 9/1991 Hsu ..... 362/287

*Primary Examiner*—Y. Quach
*Attorney, Agent, or Firm*—Cohen, Pontani, Lieberman, Pavane; Christa Hildebrand

[57] ABSTRACT

A table, desk or wall-mount lamp is disclosed which is adjustable by being rotatable and also directable into several continuous directions for focusing the light onto an object and for focusing the intensity of light towards the object which is to be illuminated. The adjustability of the lamp is achieved by rotating parts of the lamp about three different axes and by sliding a portion of the lamp. One rotation is brought about by a tension wheel which is easily controllable.

7 Claims, 6 Drawing Sheets

MULTIDIRECTIONAL TASK LAMP

BACKGROUND OF THE INVENTION

1. Field of the Invention

The present invention relates to an adjustable task lamp which is rotatable and also directable into several continuous directions for focusing the light onto an object and for focusing the intensity of light towards the object which is to be illuminated. The adjustability of the lamp is achieved by rotating a base rod within a base and by pivoting an extension arm mounted to a tension wheel and by gliding an extension arm within the tension wheel and by rotating a shade portion.

2. Description of the Related Art

Conventional lamps suitable for illuminating sections of a desk or work table are commonly fixedly mounted with clamping means to the desk or table. Any other lamps which are free-standing, do not have the flexibility of changing the directions without making certain adjustments on the lamp, i.e., opening and closing of adjustment clamps, and the like. Other task lamps, which offer a directional flexibility and which do not need clamping adjustments are constructed under reliance of utilizing a balancing principal.

A lamp which relies on a counterweight/balancing principle, is disclosed in U.S. Pat. No. 3,790,773. The disadvantages of this lamp for certain usages is that the balancing arm, which holds at its end a counterweight, is rather long the lamp and requires a clear desk or top, or it must be a flee-standing floor model. Also, the adjustment of positioning the light by the adjusting the balancing arm is limited by a wall or other objects adjacent to the desk or table.

SUMMARY OF THE INVENTION

The advantages over conventional task lamps are that the different directional positions can be achieved without loosening or tightening of any intermediary clamps and. The different directional positions of the lamp are stable until the position is changed to illuminate a different area or object. The advantage over lamps utilizing a balancing arm is that the multidirectional lamp of the present invention does not take up as much room and can be utilized in tight space.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

The invention will become more evident from the following figures and the description of the enclosed drawings.

DETAILED DESCRIPTION OF THE PRESENTLY PREFERRED EMBODIMENTS

Figure 1:
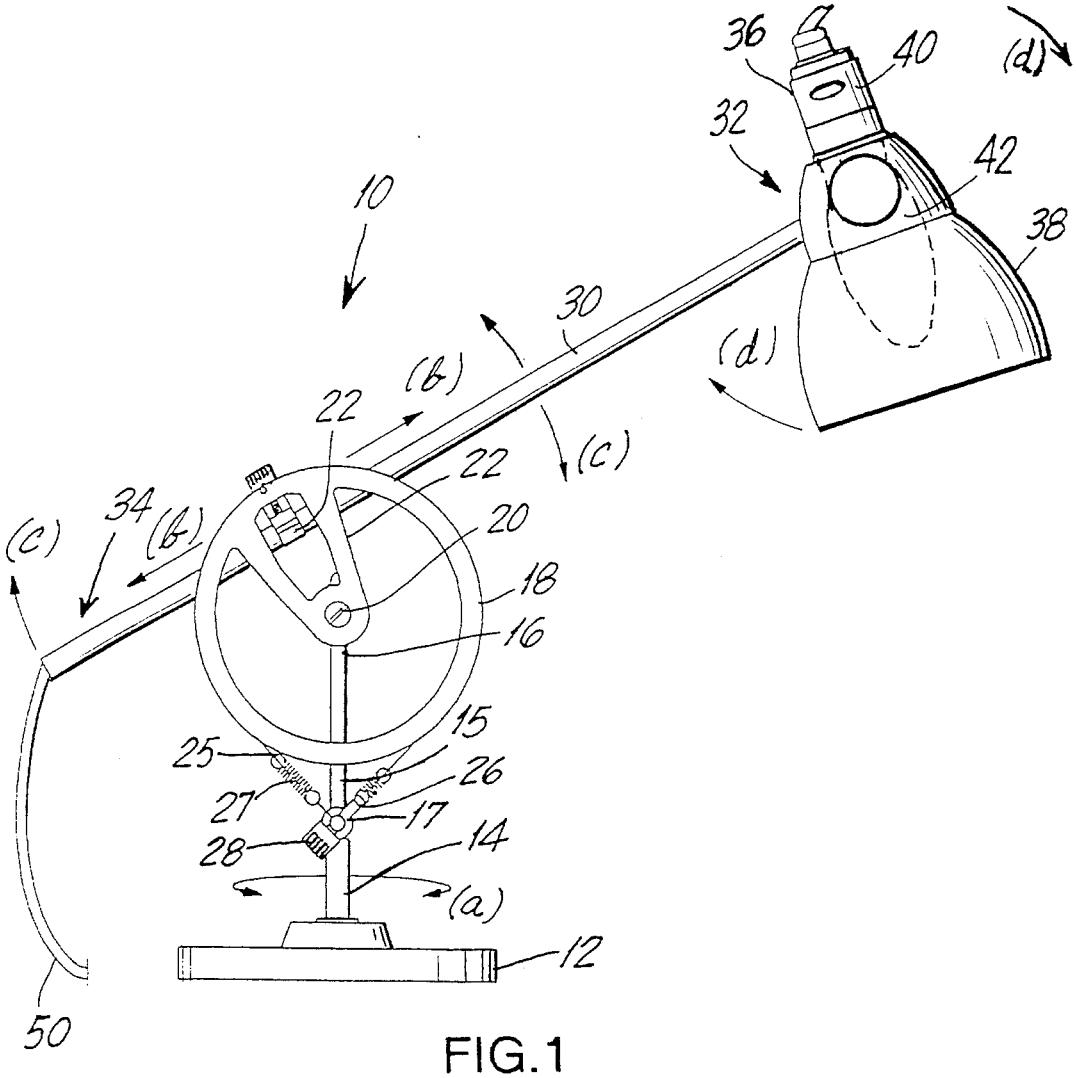
FIG. 1 is a diagrammatical side view of the multidirectional task lamp showing the front side of the tension wheel.
Figure 2:
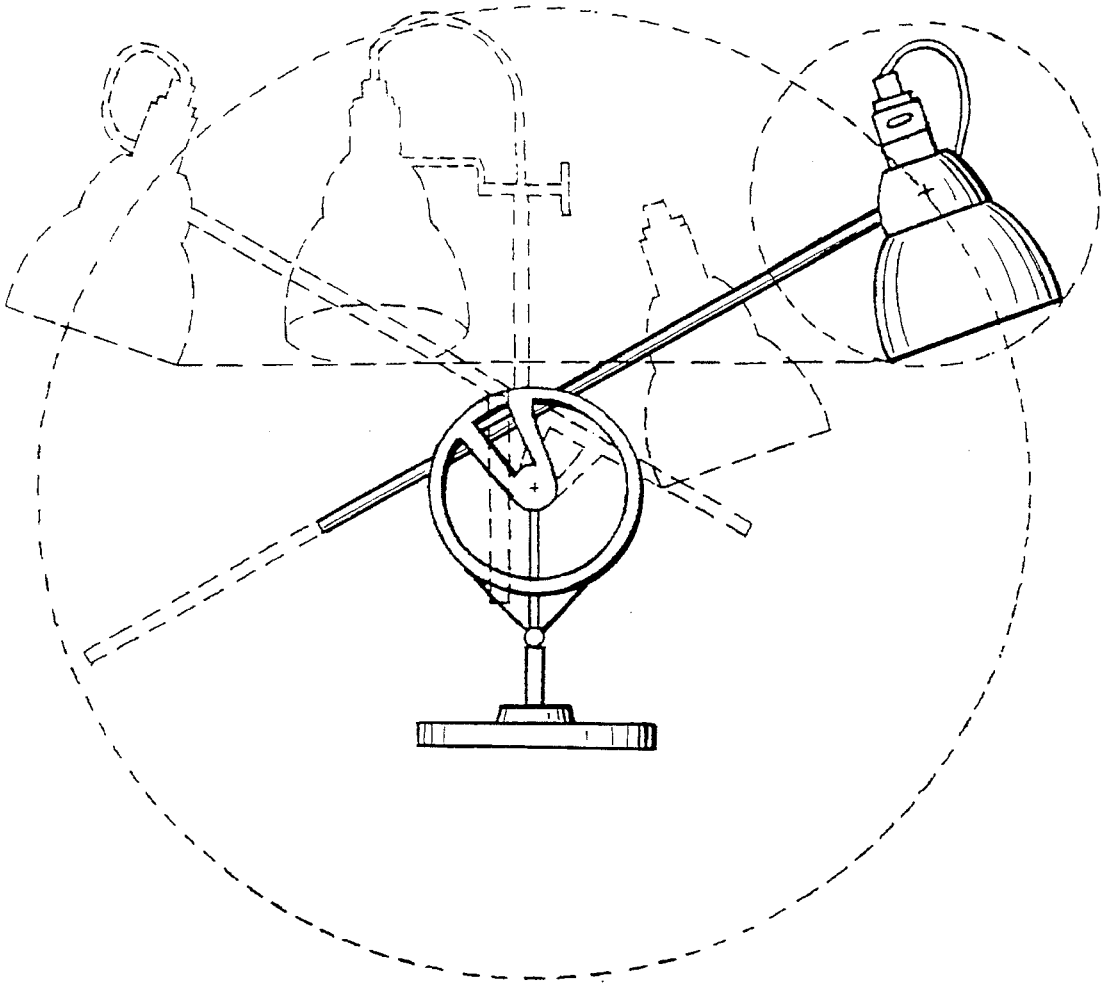
FIG. 2 is a diagrammatical side view as shown in FIG. 1, indicating different positions of adjustment.
Figure 3:
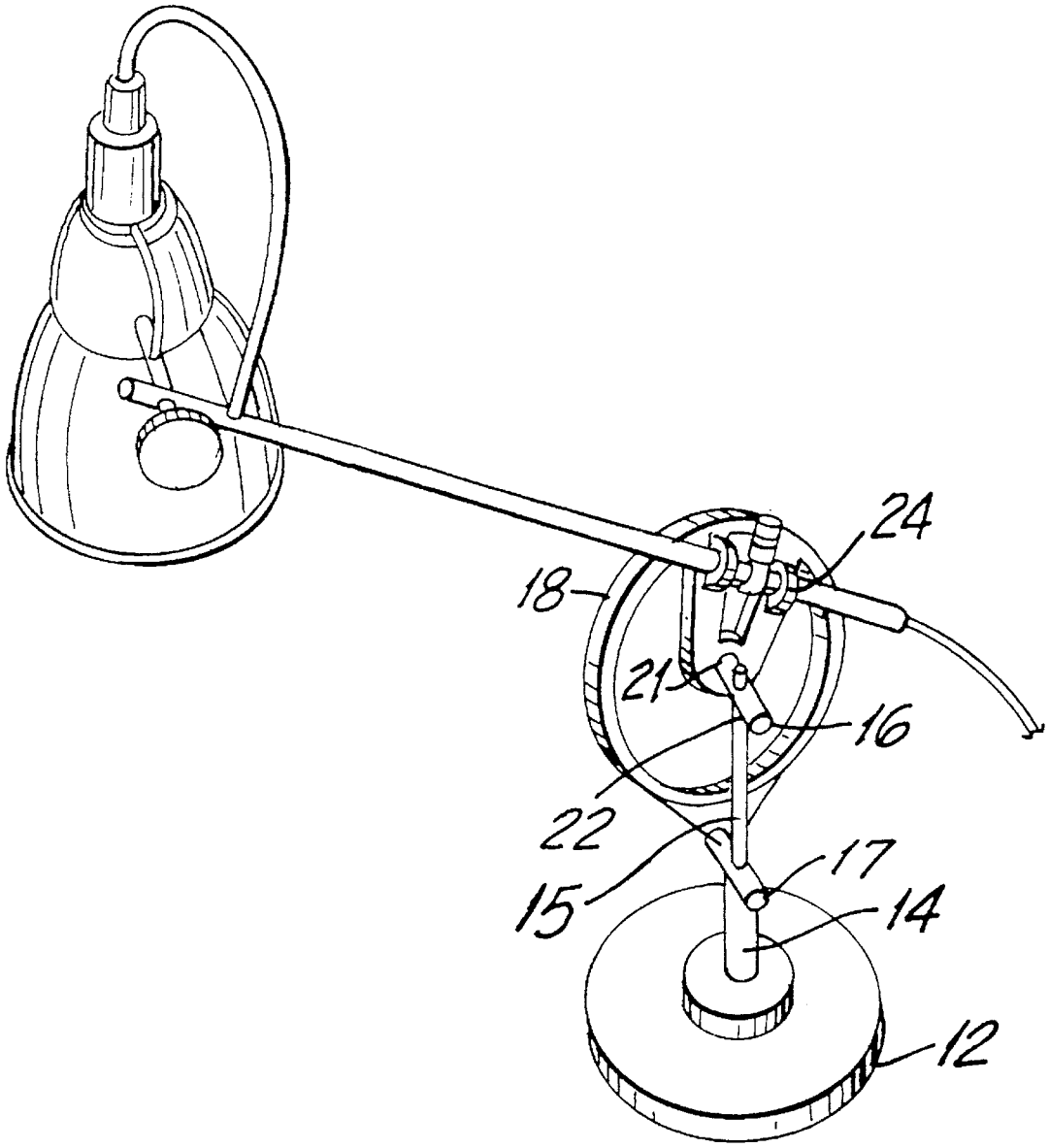
FIG. 3 is a perspective view of the task lamp showing the back side of the tension wheel.
Figure 4:
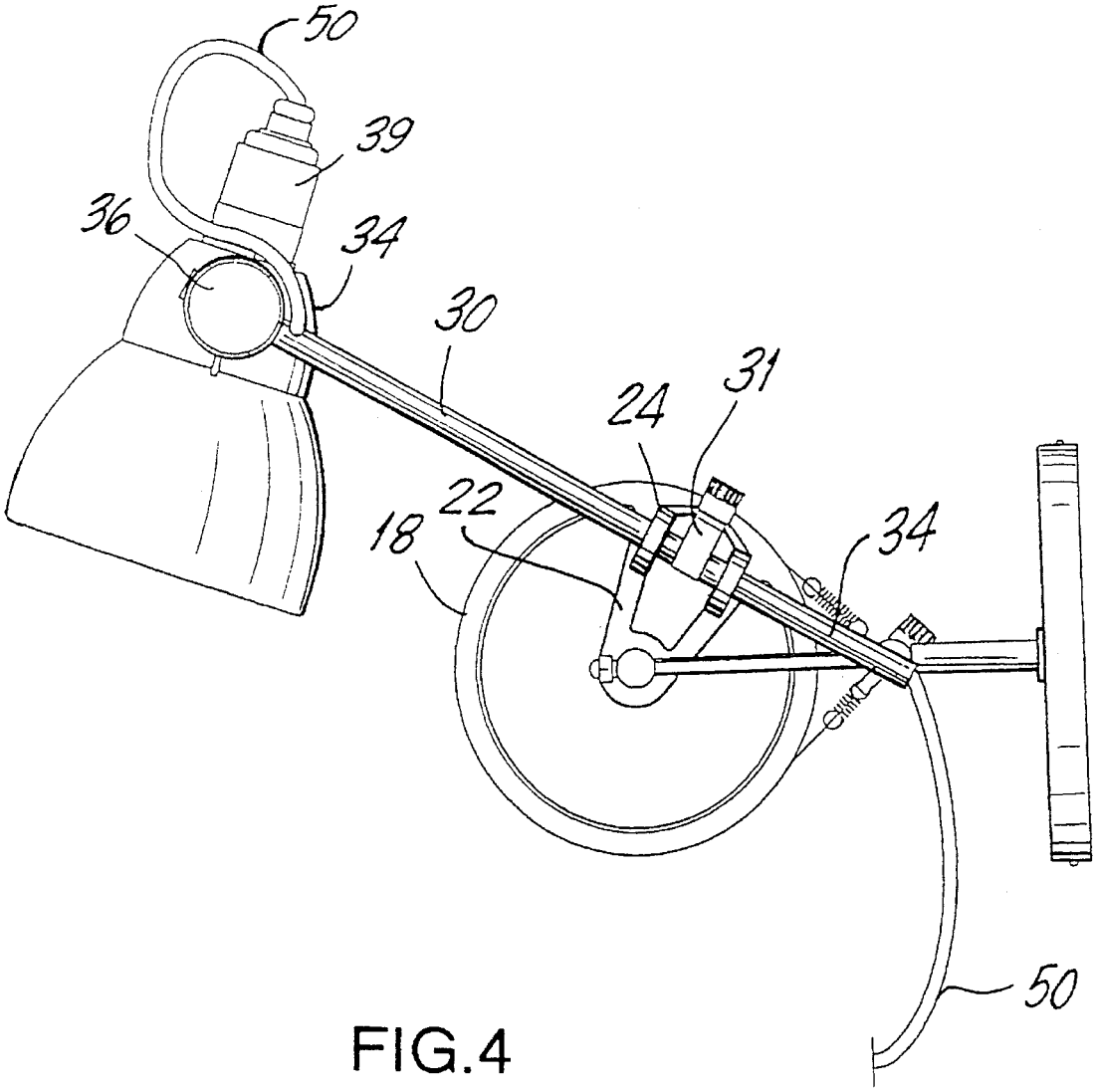
FIG. 4 is a diagrammatical side view of the multidirectional task lamp showing the back side of the tension wheel.

With reference to the figures, the lamp 10 according to the invention is shown as a desk/table model in FIGS. 1, 2 and 3 or as a wall-mount model in FIG. 4. The lamp comprises a base 12, formed as a round disk or a square/rectangular plate. Mounted to the center of the base 12 is a mounting socket 14 formed with an axial opening to accept a rod 15 which fits into the axial opening so as to allow rotatability, indicated by arrow (a). The rod extends through a bottom cross bar 17 which rests on top of the mounting socket 14. The top end 16 of the rod 15 extends through a top cross bar 21, shown in FIG. 3, which is parallel to the bottom cross bar and which extends perpendicular to the axis of the top cross bar 21. One end of the top cross bar 21 supports a tension wheel 18 in the center 20 of the tension wheel. The tension wheel 18 shaped as a disk having an axial bore or, in a preferred embodiment, it may be designed as a ring having a pie-shaped spoke or a V-shaped spoke 22 forming the center 20 of the tension wheel 18 and extending to the periphery of the wheel. Thus, the top cross-bar 21 is rotatable connected to the center 20 of the tension wheel which center is formed by an opening in the V-shaped spoke 22.

As is shown in FIG. 4, a cleat 24 is formed on the back side of the V-shaped spoke 22, where the spoke merges into the tension wheel. The cleat 24 has two openings which are formed such as to accept the mounting end 34 of the tubular extension arm 30 which is slidably mounted in the two openings in the directions indicated by arrows (b), which directions are parallel to the plane of the tension wheel. To control the slidability of the tubular arm, an adjustment screw 31 is provided to lock the tubular arm into a certain position.

The rotatability of the tubular extension arm depends on the rotatability of the tension wheel 18 about the top cross bar 21 is indicated by arrows (c) in FIG. 1. In order to control the ease of rotatability, tensioning means 25 are wrapped around the periphery of the tensioning wheel. As tension means, any wire, bands are elastic material may be utilized. One end of the tensioning means 25 merge into a spring 27, the other ends into a bolt 26. The spring 27 attaches to the bolt 26 and the bolt 26 extends through the bottom cross bar 17 and is held by a nut 28. Tightening or loosening of the nut 28 changes the tension with which the tension means 25 are held around the periphery via the spring 27. If the spring is tightened, it is harder to rotate the tubular extension arm, if the spring is loosened, it becomes easier to rotate the arm.

Figure 5:
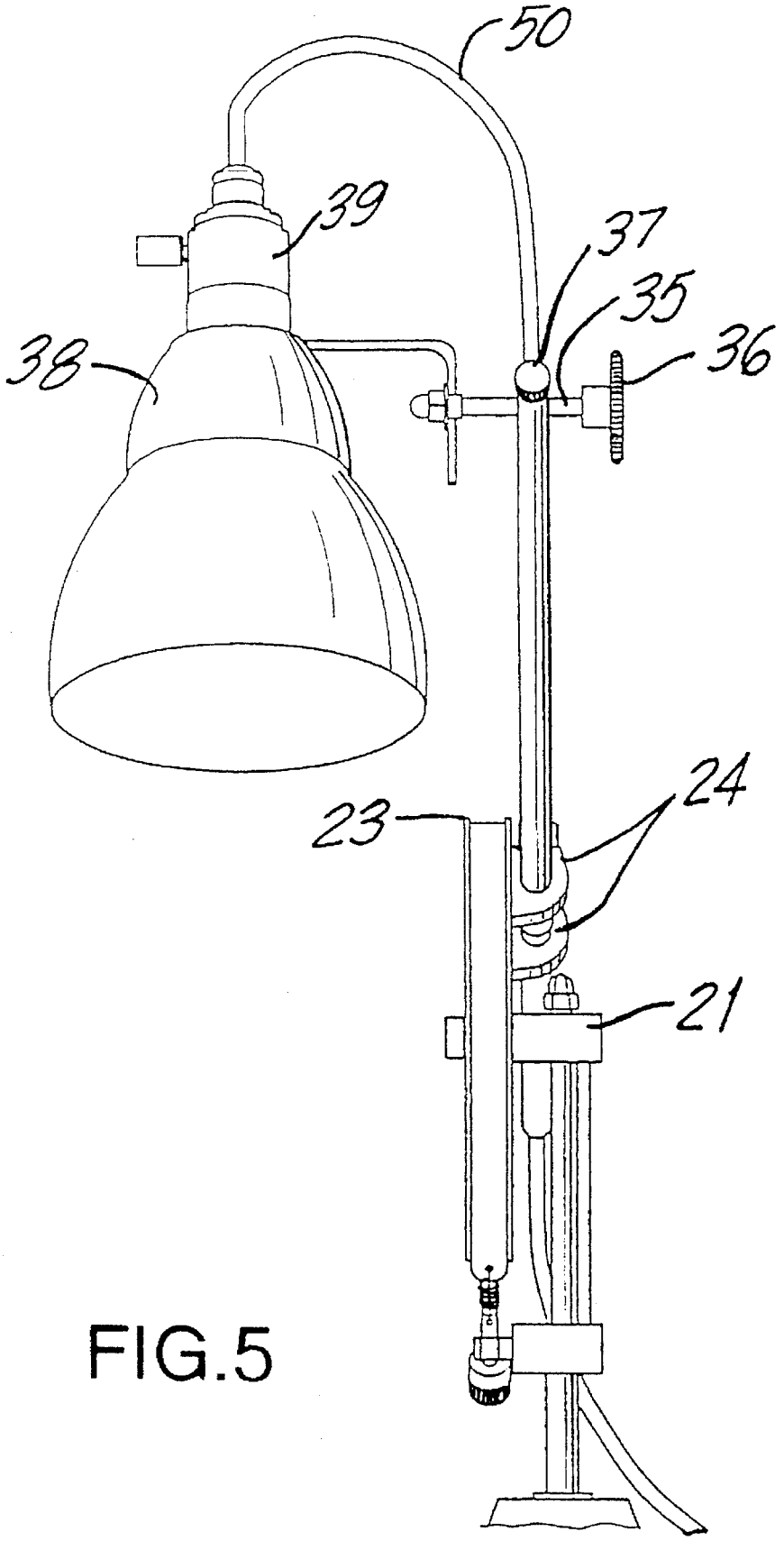
FIG. 5 is a diagrammatical front view of the multidirectional task lamp.
Figure 6:
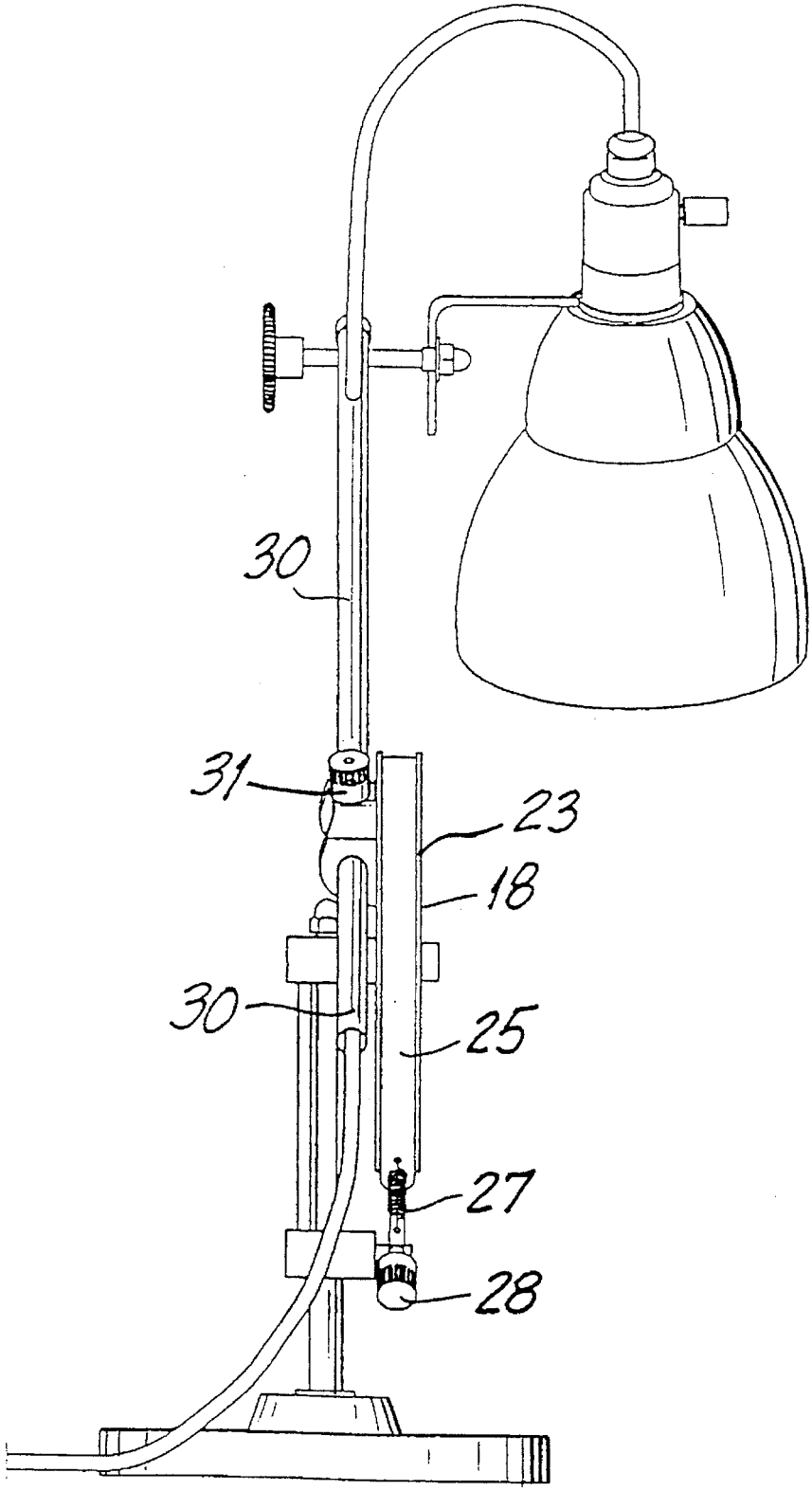
FIG. 6 is a diagrammatical rear view of the multidirectional task lamp.

To hold the tension means in place on the periphery of the tension wheel and avoid slippage, the periphery has a groove 23, as indicated in FIG. 5 and 6.

Located on the socket end 32 of the tubular extension arm 30 is a cross rod 35, as illustrated in FIG. 5. Cross rod 35 extends perpendicular through a drill hole in the socket end 32 of the tubular extension arm 30. One end of the cross rod 36 merges into a positioning nut 36, the other end of the cross rod connects to the shade 38. With the positioning nut 36, the shade 38 may be rotated in the directions indicated by arrows (d) in FIG. 1. To control the rotation of the shade 38 and to have the choice of fixing the shade 38 into a certain position, a nut 37 is provided at the socket end 32 of the tubular extension arm 30. The nut 37 engages into threads within the socket end 32 of the tubular extension arm 30 and extends to the cross rod 35 and may block the cross rod 35 in the extension arm 30, thereby locking the shade 38 into a certain position.

A conventional electric cord 50 extends through the tubular extension arm. The cord 50 is guided out of the extension arm 30 below the cross bar 35 as illustrated in FIGS. 3, 4, 5 and 6 so that the cord does not interfere with the cross bar 35. The cord extends into a conventional socket 39 having, for example, a conventional switch 40 and is connected to a bulb 42, indicated in FIG. 1.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A multidirectional task lamp comprising:

a base;

a mounting socket;

a rod;

a tension wheel having an axial opening and a peripheral cleat;

a tubular extension arm including a socket end and a mounting end;

a shaded socket portion;

said mounting socket is disposed on said base;

said rod rotatably extends between said mounting socket and said axial opening;

said cleat includes an opening configured for slidably accepting said tubular extension arm;

said tension wheel is rotatably connected to the rod via a cross bar associated with said rod;

tension means associated with said tension wheel and another cross bar associated with said rod for controlling the rotatability of the tension wheel;

said shaded socket portion is rotatably disposed on said socket end on said tubular extension arm;

an electrical connection is guided through said tubular extension arm to provide an electrical connection to said socket end.

2. The multidirectional task lamp of claim 1, wherein the base is suitable for wall mounting.

3. The multidirectional task lamp of claim 1, wherein the tension wheel is a ring-shaped wheel having a V-shaped spoke extending between a center of said ring shaped wheel and a periphery thereat.

4. The multidirectional task lamp of claim 3, wherein the tension wheel comprises a groove on the periphery of the tension wheel for avoiding slippage of the tension means.

5. The multidirectional task lamp of claim 1, wherein the tension means comprises a wire.

6. The multidirectional task lamp of claim 1, wherein the tension means comprises a flat band.

7. The multidirectional task lamp of claim 1, wherein the tension means comprises an elastic band.

* * * * *